United States Patent [19]

Ozaku

[11] Patent Number: 4,993,335

[45] Date of Patent: Feb. 19, 1991

[54] HOOKING ARRANGEMENT FOR TWO-NEEDLE LOCKSTITCH SEWING MACHINES

[75] Inventor: Minoru Ozaku, Chofu, Japan

[73] Assignee: Juki Corporation, Tokyo, Japan

[21] Appl. No.: 356,573

[22] Filed: May 23, 1989

Related U.S. Application Data

[63] Continuation of Ser. No. 186,705, Apr. 20, 1988, abandoned, which is a continuation of Ser. No. 912,339, Sep. 26, 1986, abandoned.

[30] Foreign Application Priority Data

Sep. 26, 1985 [JP] Japan ..... 60-213272

[51] Int. Cl.[5] ..... D05B 1/12; D05B 57/08

[52] U.S. Cl. ..... 112/163; 112/184

[58] Field of Search ..... 112/184, 163, 164, 165, 112/166, 167, 222

[56] References Cited

U.S. PATENT DOCUMENTS

| | | | |
|---|---|---|---|
| 398,323 | 2/1889 | Griffin | 112/164 |
| 401,776 | 4/1889 | Dewees | 112/166 |
| 1,269,118 | 6/1918 | Ringe | 112/184 X |
| 1,591,319 | 7/1926 | Johnson | 112/164 |
| 1,638,338 | 8/1927 | Jacobs et al. | 112/164 X |
| 2,862,468 | 12/1958 | Johnson | 112/464 |
| 3,433,191 | 3/1969 | Goeber et al. | 112/166 |

FOREIGN PATENT DOCUMENTS

| | | | |
|---|---|---|---|
| 976208 | 11/1964 | United Kingdom | 112/184 |

OTHER PUBLICATIONS

Bayer, "Problems With Multi-Directional Sewing", *Bobbin*, vol. 23, p. 97 (Jul., 1982).

*Primary Examiner*—Wm. Carter Reynolds

*Attorney, Agent, or Firm*—Morgan & Finnegan

[57] ABSTRACT

A two-needle lockstitch sewing machine apparatus providing a hooking arrangement such that each thread loop is positioned in the same direction in relation to the needle position. The hooking arrangement is effective to stitch each left and right stitch line with a needle thread having almost the same degree of twist. Thus, uniform stitch lines are obtained and the "edge effect" which is often experienced when the needle thread passes through the needle eye during stitching is eliminated.

1 Claim, 4 Drawing Sheets

HOOKING ARRANGEMENT FOR TWO-NEEDLE LOCKSTITCH SEWING MACHINES

This is a continuation of application Ser. No. 07/186,705 (now abandoned), filed on Apr. 20, 1988, which is a continuation of application Ser. No. 06/912,339 (now abandoned), filed on Sept. 26, 1986.

BACKGROUND OF THE INVENTION

This invention relates to an improvement in the hooking arrangement for two-needle lockstitch sewing machines More particularly, this invention relates to the relative position between needles and hooks in two-needle lockstitch sewing machines.

The relative positions of the needles and hooks in a conventional two-needle lockstitch sewing machine are shown in FIGS. 5a and 5b. FIG. 5a is a plan view of the needles and hooks and FIG. 5b is a front view of the needles $K_1$ denotes a left hook and $K_2$ denotes a right hook. $KK_1$ and $KK_2$ denote left and right hook points, respectively $N_1$ and $N_2$ denote left and right needles, respectively. $T_1$ denotes a left needle thread and $T_2$ denotes a right needle thread. Arrows in FIG. 5a show the rotational direction of each hook $K_1$ and $K_2$, respectively.

In the above-described needle and hook arrangement, each needle thread's passageway is preferably symmetrically arranged and each hook hooks a thread loop formed on the outer side of the needle. Thus, the stitching for each needle thread is performed.

FIG. 6 is a plan view illustrating the relation between the direction of threading and the stitching $S_1$, $S_2$. During stitching $S_1$, $S_2$, the squeezing (displacement of twist) direction for the needle thread when it passes through the needle eye is different for each of the needles $N_1$, $N_2$.

Generally, Z-twist threads are used for sewing machines The displacement of twist by Z-twist thread due to the edge effect of the needle eye is shown in FIG. 7.

Referring to FIG. 7, each thread is a Z-twist type and each left and right needle $N_1$, N, is rotated by 90 degrees counter clockwise around the needle axis from the original position of FIG. 5b to illustrate the displacement of twist for each needle In this drawing, the displacement of twist for each needle thread is exaggerated for illustration.

As illustrated, when each needle thread passes through the needle eye, the squeezing direction is different for each of the needle threads Thus, the direction of displacement of the twist for each thread is opposite In case of the right needle $N_2$, the twist advances from the needle eye to the upper side and, accordingly, the stitching $S_2$ will be performed with the loose-twist thread.

In case of the left needle $N_1$, on the other hand, the twist advances from the needle eye to the lower side and, accordingly, the stitching $S_1$ will be performed with the more-twisted thread. Although the left and right thread had a uniformly equal degree of twist when each was set in a bobbin, after stitching with the two-needle lockstitch machine the left stitch line is stitched with the more-twisted thread and the right stitch line is stitched with the loose-twist thread. Thus, stitching is not uniformly performed. In particular, the left needle may be problematic and cause accidental thread cut, or disorderly stitching such as wobbling or balloon stitch (isolated idle loop).

The above described displacement of the twist in the needle thread during stitching with the two-needle lockstitch sewing machine is caused by the edge effect of the needle eye. How this displacement causes problems is described in the report "The Displacement of the Twist in the Needle Thread during Sewing Process", in the "Journal of the Textile Machinery Society of Japan" Vol. 37, pp. 185-193, April, 1984.

To solve these problems, a combination of S-twist thread for the left needle and Z-twist thread for the right thread has been applied. The arrangment of using S-twist thread for a small quantity of workpiece results in higher costs and therefore such application is limited only to where mass production is used.

In another arrangement, the rotational direction of the hooks may be altered to be oppositely directed (one clockwise and the other counter clockwise). This arrangement alone does not solve the problem either Adjustment of the shape of the needle eye edge or loosening of the thread tension have also been tried, but these arrangements are restrictive and have also proved insufficient to solve the problem.

SUMMARY OF THE INVENTION

With the foregoing in mind, it is an object of the invention to provide a two-needle sewing machine utilizing Z-twist thread for both the left and right needles and providing uniform left and right stitch lines.

According to the invention, the relative positions of the needles between the reciprocating needles and the rotating hooks are arranged such that the position of each thread hook is situated in the same direction in relation to the needle position.

The relative positions of the needles and hook points according to the invention causes the displacement of twist for each needle thread to be advanced in the same direction. Thus, uniform stitching of both the right and left stitch lines are maintained and accidental thread cut and disorderly stitching are eliminated.

BRIEF DESCRIPTION OF THE DRAWINGS

The accompanying drawings, referred to herein and constituting a part hereof, illustrate preferred embodiments of the invention and, together with the description, serve to explain the principle of the invention, wherein.

DETAILED DESCRIPTION OF THE DRAWINGS

Figure 1:
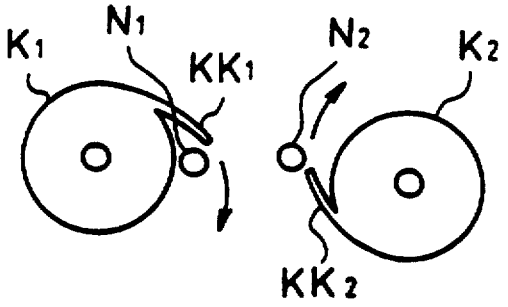
FIG. 1a is a plan view illustrating the relative position of the needles and hooks according to the invention.
FIG. 1b is a front view illustrating the relative position of the threads and needles.
Figure 1:
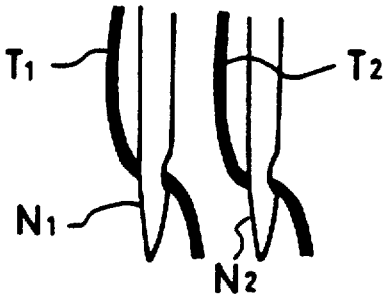
Figure 3:
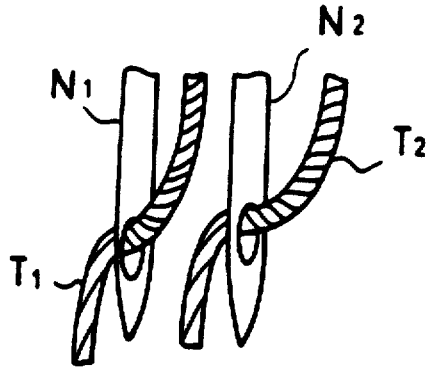
FIG. 3 is a front view illustrating the direction of threading according to the invention.
Figure 4:
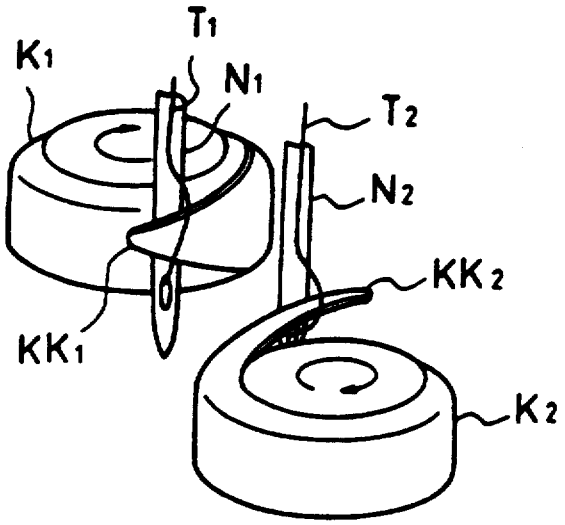
FIG. 4 is a perspective view illustrating the relative position of the needles and hooks and the direction of threading.

Referring to the accompanying drawings, one embodiment of this invention will be explained hereinafter FIG 1*a* is a plan view illustrating the relative position of the needles and hook points according to the invention. FIG. 1*b* is a front view illustrating the relative position of the needles and needle threads according to the invention FIG. 4 is a perspective view of FIG. 1. The same numerals are applied to the similar parts throughout the accompanied drawings, FIG. 1–FIG. 7.

Figure 5:
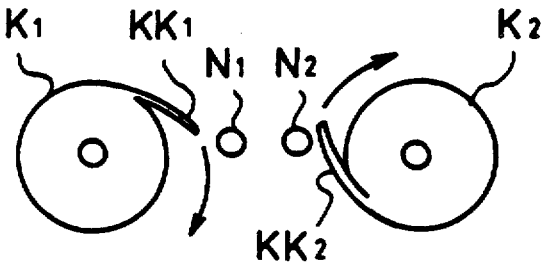
FIG. 5 (a) PRIOR ART
FIG. 5a is a plan view illustrating the relative position of the needles and hooks in a conventional two-needle lockstitch sewing machine.
FIG. 5b is a front view illustrating the relative positions of the threads and needles in a conventional two-needle lockstitch sewing machine.
Figure 5:
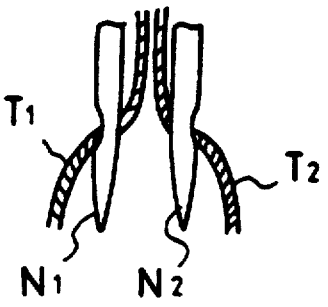
FIG. 5 (b) PRIOR ART
Figure 6:
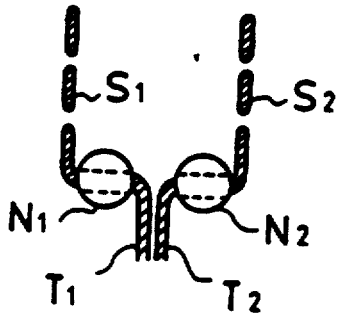
FIG. 6 PRIOR ART
FIG. 6 is a plan view illustrating the relation between the direction of threading and the stitching in a conventional two-needle lockstitch sewing machine.
Figure 7:
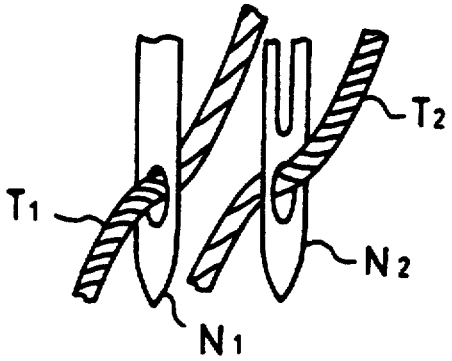
FIG. 7 PRIOR ART
FIG. 7 is a front view illustrating the displacement of twist each needle in a conventional two-needle lockstitch sewing machine.

Referring to FIG. 5, illustrating the prior art, each thread loop is formed on the outer side of the needle and each hook point $KK_1$, $KK_2$ hooks each loop.

Figure 2:
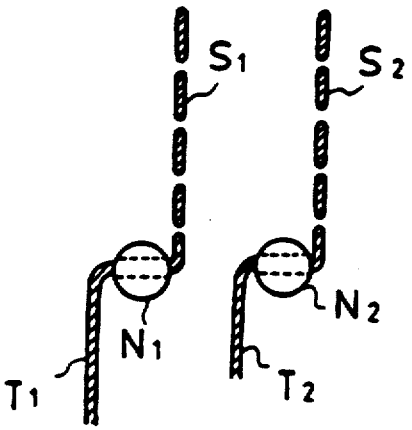
FIG. 2 is a schematic plan view illustrating how stitching is performed according to the invention.

In the embodiment shown in FIGS. 1 and 2, the right hook $K_2$ hooks the thread loop formed on the outer side of the needle, while the left hook $K_1$ hooks the thread loop formed on the inner side of the needle. As illustrated in FIGS. la and lb, each hook point $KK_1$, $KK_2$ passes on the right side of each needle $N_1$, $N_2$. More particularly, the right hook point $KK_2$ passes on the outer side of the right needle $N_2$ and the left hook point $KK_1$ passes on the inner side of the left needle $N_1$. In this embodiment, the threading for each needle is illustrated in FIG. 3 which shows the right needle thread $T_2$ threading from inner to outer while the left needle thread $T_1$ threads from outer to inner. By this arrangement, the direction of squeezing for each needle thread $T_1$, $T_2$ is kept almost the same.

FIGS. 3 and 4 illustrate the influence of the squeezing according to the invention wherein Z-twist thread is utilized for each needle thread $T_1$, $T_2$ and the squeezing is illustrated in an exaggerated condition. As shown in FIG. 3, the number of twists for each needle thread tends to decrease as the needle thread advances from the needle eye downward and tends to increase from the needle eye upward.

As previously described, in the conventional type of two-needle lockstitch sewing machine the left needle $N_1$ was often problematic. According to the instant invention, the situation of the left needle $N_2$ is similar to that of the right needle $N_1$. Thus, uniform stitching is produced and accidental thread cut and disorderly stitching is eliminated.

In the above described embodiment, Z-twist thread is used for each needle thread and the right hook point $KK_2$ hooked the loop formed on the outer side of the right needle $N_2$ and the left hook point $KK_1$ hooked the loop formed on the inner side of the left needle $N_1$. If S-twist threads are used, the right hook point hooks the loop formed on the inner side of the right needle and the left hook point hooks the loop formed on the outer side of the left needle Thus, the displacement of twist (squeezing) for each thread is advanced in the same direction.

As an alternative embodiment of this invention, the combination of one of the hooks rotating clockwise and the other hook rotating counter clockwise is also possible.

As many apparently widely different embodiments of the invention may be made without departing the spirit and scope therein, it is to be understood that invention is not limited to the specific embodiment thereof except as defined in the appended claims.

I claim:

1. A hooking arrangement for a two-needle lockstitch sewing machine, comprising a first thread hook and a second thread hook, each of said thread hooks rotating horizontally in the same direction;

a first needle and a second needle, each of said needles positioned between said first and second thread hooks and having an opening oriented such that a first needle thread and a second needle thread passes through the openings in said first and second needles, respectively, in the same direction;

said first thread hook having a first hook point which hooks said first thread between said first needle and said second needle; and said second thread hook having a second hook point which hooks said second thread between said second needle and said second hook.

* * * * *